United States Patent [19]

Goerlitz

[11] Patent Number: 4,674,262

[45] Date of Patent: Jun. 23, 1987

[54] DEVICE FOR RELEASABLY HOLDING A CONTAINER ON A FEED CONNECTION PIECE

[75] Inventor: Frank-Otto Goerlitz, Braunschweig, Fed. Rep. of Germany

[73] Assignee: Bühler-Miag GmbH, Braunschweig, Fed. Rep. of Germany

[21] Appl. No.: 840,645

[22] Filed: Mar. 17, 1986

[30] Foreign Application Priority Data

Mar. 23, 1985 [DE] Fed. Rep. of Germany ..... 3510701

[51] Int. Cl.[4] ..... B65B 1/04

[52] U.S. Cl. ..... 53/261; 285/322; 285/243; 141/382; 141/383; 279/2 A

[58] Field of Search ..... 285/9, 97, 18, 161, 285/200, 243, 258, 370, 322, 920; 141/382, 383, 385, 386, 368; 53/255, 260, 261; 279/2 R, 2 A, 4

[56] References Cited

U.S. PATENT DOCUMENTS

| | | | |
|---|---|---|---|
| 1,820,406 | 8/1931 | Thompson | 141/383 |
| 2,348,144 | 5/1944 | Opie | 53/261 |
| 2,827,312 | 3/1958 | Spencer | 283/97 |
| 2,901,875 | 9/1959 | Hultkrans et al. | 53/261 |
| 3,036,415 | 5/1962 | Ayres et al. | 53/261 |
| 3,643,982 | 2/1972 | Murphy | 141/383 |
| 4,207,934 | 6/1980 | Scremin et al. | 141/383 |
| 4,221,106 | 9/1980 | Aitenponl et al. | 53/261 |

FOREIGN PATENT DOCUMENTS

| | | | |
|---|---|---|---|
| 2417159 | 10/1975 | Fed. Rep. of Germany | 53/260 |
| 7727248 | 1/1978 | Fed. Rep. of Germany . | |
| 65944 | 1/1950 | Netherlands | 141/383 |
| 7308339 | 12/1974 | Netherlands | 285/162 |
| 794447 | 5/1958 | United Kingdom | 141/383 |
| 1170921 | 11/1969 | United Kingdom | 285/97 |
| 540101 | 12/1976 | U.S.S.R. | 285/97 |

*Primary Examiner*—Cornelius J. Husar
*Assistant Examiner*—Eric K. Nicholson
*Attorney, Agent, or Firm*—Michael J. Striker

[57] ABSTRACT

A device for temporarily holding containers on a feed connection piece includes a plurality of expanding segments surrounding the connecting piece and being held in position thereon by a resilient sleeve. Lower parts of respective segments extend over a lower edge on the connecting piece and are tilted by levers attached to a top edge of respective segments so as to expand the elastic sleeve into engagement with an inner surface of a container. The expanding segments are returned into their rest position by the resilient constricting force of the sleeve.

7 Claims, 3 Drawing Figures

DEVICE FOR RELEASABLY HOLDING A CONTAINER ON A FEED CONNECTION PIECE

BACKGROUND OF THE INVENTION

The present invention relates to a device for a temporary attachment of a container, preferably of an elastic container, in a filling position on a feed connection piece. The device is of the type which includes expanding members movable against inner wall of the container, thus affixing the same in filling position.

In charging or filling loose goods or liquids moving through a feed connection piece, into elastic or flexible containers such as for example bags or sacks, it is necessary to hold the container at least for the time interval of feeding in a fixed open position below the feed connection piece. In addition, in order to prevent the discharge of granular goods from the connection piece past the container it is advantageous when the connection piece projects into the container and the latter is directly attached to the connection piece whereby a tight seal against ambient environment is usually desired.

From the German Publication DE-GM No. 77 27 248 a device is known in which open part of sacks to be filled is drawn over two holding yokes of suitable shape whereupon the latter are pressed apart from the other by a spring force to exert pressure against the inner surface of the sack and simultaneously fix the same in its open filling position. The disadvantage of this prior art device is its relative complexity requiring an expensive system of pedals, deviation levers, ropes and springs while the problem of sealing the gap between the feed connection piece and the sack is not solved. In all prior art devices of this kind using mechanical expansion members in the form of holding yokes, levers and the like, the path and force of movement of the expansion members acting on the inner wall of the container can be readily realized. However the sealing action between the container and the feed connection piece has always presented problems in practice.

Other known devices of this kind which consider the sealing problem for example by using inflatable sealing organs such as rubber rings inflatable against the inner walls of containers to be charged, are more advantageous. Nevertheless, even in this case disadvantages are present because of generally smaller path of travel of the expansion organs in comparison with before described mechanical expansion systems, or oversized and large volume inflatable expansion organs must be used. Moreover, pneumatic holding systems of this kind do not act against a limit stop but only engage against the material of the container being filled. Consequently, in the event of pressure fluctuations the flexible container is prone to be over expanded or alternatively is insufficiently held in a fixed position.

SUMMARY OF THE INVENTION

It is therefore a general object of the present invention to overcome the disadvantage of prior art holding devices of this kind.

In particular, it is an object of this invention to unite advantages of systems operating with mechanical expansion organs, namely relatively long clamping parts well defined by a fixed end stop, with the important advantage of improved seal of systems operating with inflatable organs.

An additional object of this invention is to provide such a unified holding device which is simpler and more compact in construction and lower in weight in comparison with prior art devices.

Still another object of this invention is to provide such an improved holding device which due to its reduced weight and size is particularly suitable for use in connection with transportable dosing and weighing apparatuses.

In keeping with these objects and others which will become apparent hereafter, one feature of this invention resides in the provision of a plurality of expansion segments surrounding a rim of a connection piece, a resilient sleeve constricting the segments against an outer wall portion of the connection piece, each segment having an upper part contacting the outer wall portion and a lower part extending over the rim of the connection piece, and levering means acting on the upper parts of the segments to pivotably displace the same against the constricting force of the sleeve, thus expanding a sleeve portion against an inner surface of a container.

In a preferred embodiment of this invention, the feed connection piece has a cylindrical jacket while the expansion segments have a planar flat configuration whereby the size and the number of the segments is designed such as to constitute polygon which in nonexpanded condition approximates the circular cross sectional area of the outlet of the connection piece. In this manner the sealing effect of the elastic or resilient sleeves expandable by the expanding elements is further improved.

Furthermore, particularly in an automatic filling operation where containers of approximately circular cross section are held in a fixed filling position on the feed connection pieces, it is of advantage when according to another modification of this invention the lower parts of the segments in their rest position converge in the direction toward the center axis of the connection piece. In this manner any failure in positioning the containers on the connection piece is effectively prevented and the holding device always reliably engages the container.

Due to its design which guarantees a reliable operation at reduced weight, installation space and manufacturing costs, the invention is particularly suitable for application in transportable dosing and weighing devices. For this purpose, according to a further elaboration of this invention the jacket of the feed connection piece is provided with a stop collar supporting an inner side of a hollow lifting ring which slides in axial direction on the jacket of the connecting piece. The levering means cooperate with an actuation arm firmly connected at an acute angle to the upper edge of each segment so that the actuation arm in inactive condition of the device is inclined downwardly. The connection point of the actuation arm and of the upper edge of each segment abuts against the stop collar whereas the free end of the actuation arm rests on the inner bottom surface of the lifting ring. The lower parts of respective segments which converge downwardly toward the center axis of the connecting piece and being held together by the resilient sleeve pressing the upper part of respective segments against the jacket of the connecting piece, can be controlled in surprisingly simple manner by lifting the free end of the actuation arm whereby the segments are pivoted at their contact point with the stop collar to move outwardly, thus expanding the surrounding resilient sleeve. The degree of expansion is determined by the magnitude of the acute angle formed by the actuation arm.

In order to preclude any minute leakage of the treated material in the range between respective expanding segments and the stop collar, according to a further elaboration of this invention a lower range of the lifting ring is covered by an elastic collar forming an extension of the upper part of the elastic sleeve.

In order to design the lifting mechanism for the lifting ring as simple as possible and in order to eliminate reaction forces acting downwards during the lifting movement and causing erroneous reading particularly in dosing weighing devices, there is provided, according to another feature of this invention, an inflatable pressure hose arranged between the stop collar and the inner top surface of the lifting ring.

With advantage, the elastic sleeve apart from its sealing, holding and resetting function performs still another function which is important for a reliable holding of the container in position, namely the outer surface of the sleeve is provided with serrations which increase friction on the inner wall of the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
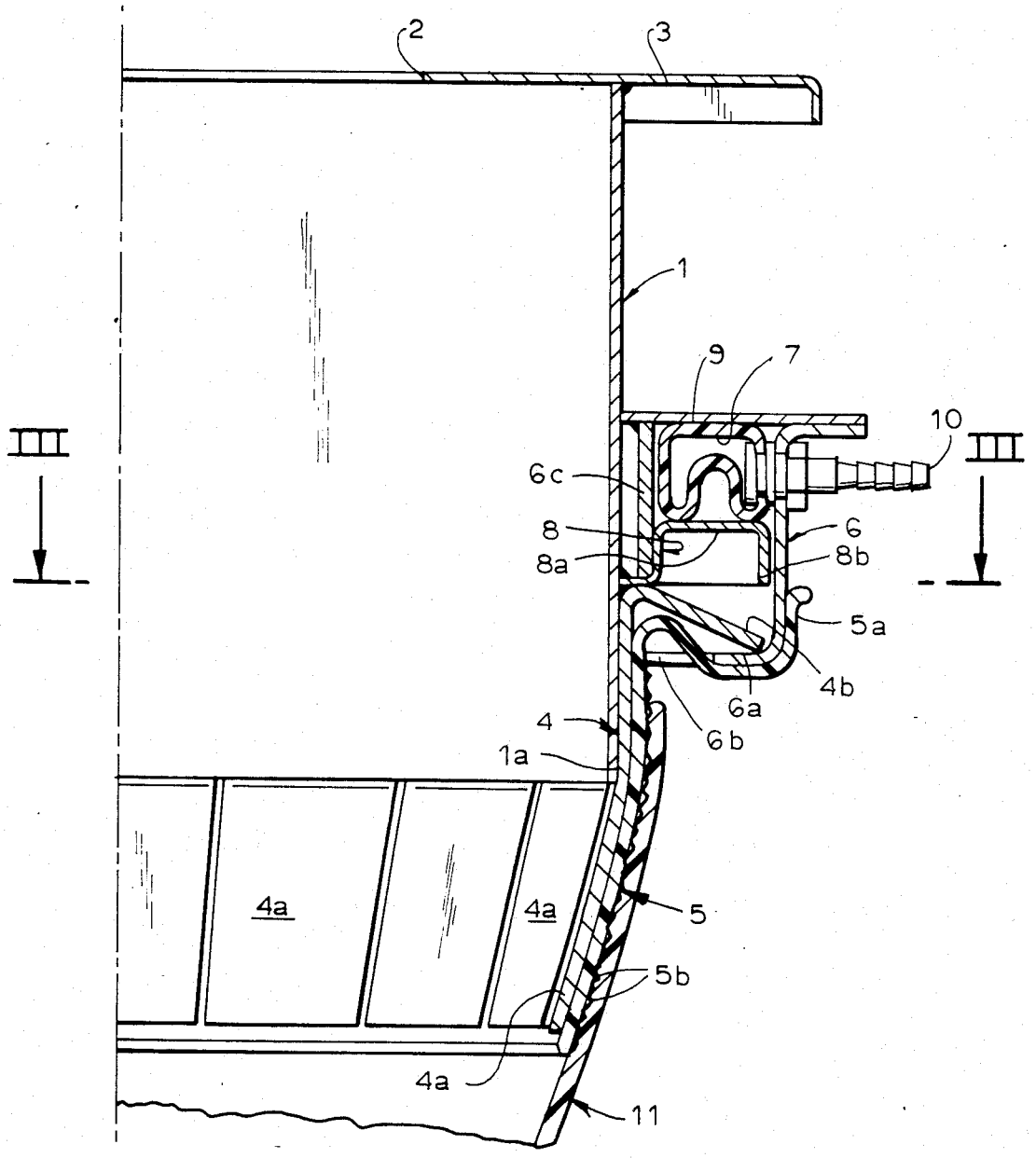
FIG. 1 is a cutaway view partly in section of the holding device of this invention shown in its inactive condition.

The releasable holding device shown in the figures is inserted on the cylindrical jacket of a feed connection piece 1 whose top edge is provided with an inlet opening 2 for a material to be charged into a nonillustrated container, and with a peripheral flange 3 for attachment to an outlet of a weighing device for example.

The holding device of this invention includes a plurality of expanding segments arranged side by side and surrounding the periphery of a lower portion of the jacket of the connecting piece 1. The segments are surrounded by a resilient sleeve 5 which elastically presses upper parts of the segments against the jacket of the connecting device. The piece further includes a lifting ring 6 provided with an inflatable pressure hose 7 cooperating with levering actuation arms 46 of the segments.

Figure 3:
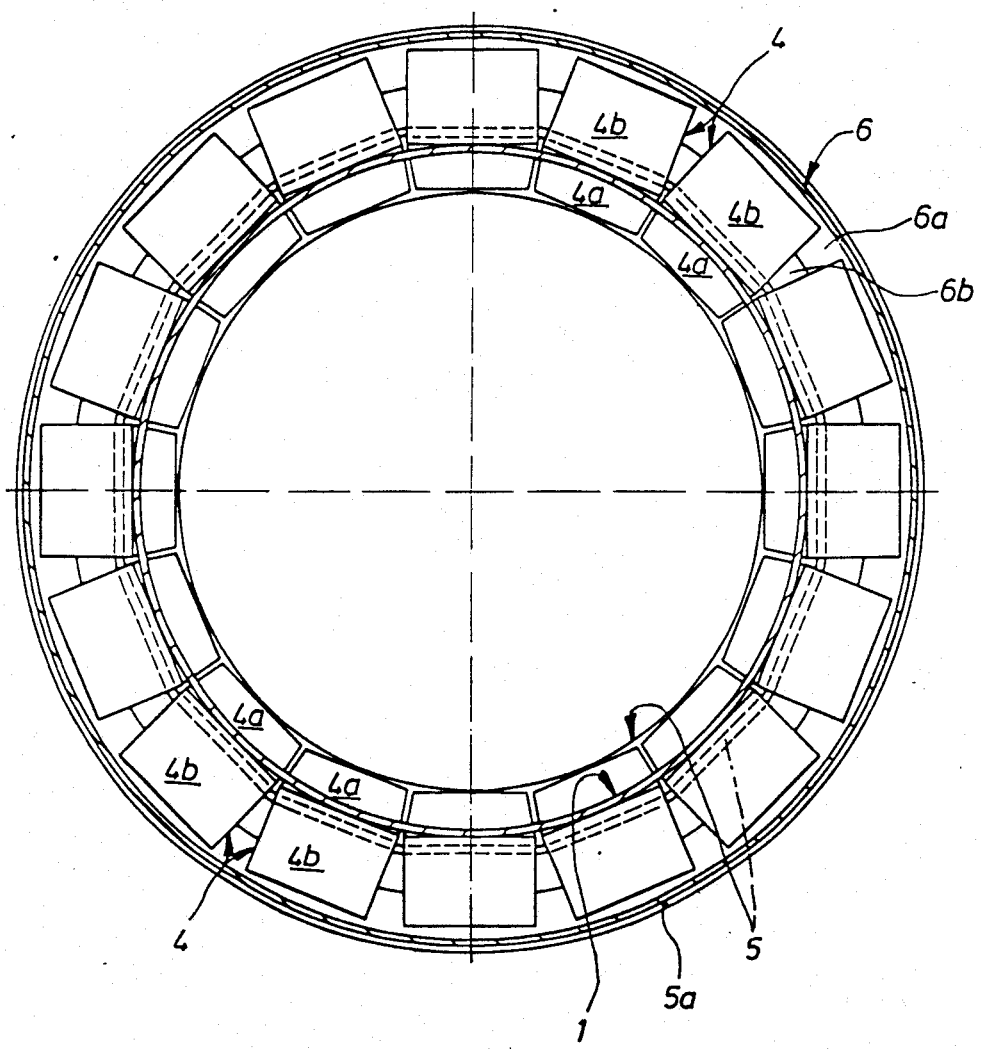
FIG. 3 is a sectional plan view of a complete device of FIG. 1 taken along the line III—III.

In order to simplify the manufacture the expanding segments 4 are preferably made in the form of angular levers of flat configuration whereby a large number of such segments (see FIG. 3) are uniformly distributed on the periphery of the lower portion of the jacket of the cylindrical feed connection piece 1 and held thereon by the tightly constricting resilient sleeve 5. In this manner, the cross sectional area enclosed by the planar expanding segments approximates the circular cross section of the connecting piece. Lower parts 4*a* of respective segments are bent inwardly to overlap the lower edge 1*a* of the connecting piece and to converge inwardly to a point on the center axis of the connecting piece. This converging arrangement facilitates the insertion of the segments into the open part of the container to be filled. An intermediate part of each segment 4 is in contact with the jacket of the connecting piece 1 whereas the top part of each segment is bent at sharp angle relative to the intermediate part to form an actuation arm 4*b*. The free ends of all actuation arms 4*b* rest on inner bottom surface 6*a* of a hollow lifting ring 6 whose inner wall 6*c* in inactive condition of the device rests on a stop collar 8 surrounding the connection piece 1 and being secured to its jacket. The hollow lifting ring 6 encloses an inflatable pressure hose 7 arranged between a top surface 8*a* of the stop collar 8 and an inner surface of a top wall 9 of the ring 6. The outer bottom edge 8*b* of the stop collar acts as a stop surface for the tips of actuation arms 4*b*, thus delimiting the expansion of the overlapped segment portions 4*a*. As mentioned before, in inactive condition of the holding device of this invention the tip edges of actuated arms 46 contact corresponding lines on the inner surface of the bottom side 6*a* of the lifting ring. The continuous annular opening 6*b* between the bottom side 6*a* and the jacket of the connecting piece serves for receiving a fold in the upper part of the sleeve 5 which transits into a resilient collar 5*a* surrounding the entire lower range of the lifting ring 6 to provide a seal preventing any escape of fed material through gaps between expanded segments. In a simpler modification of this invention, the elastic sleeve 5 encloses the expanding segments 4 only to the level of their connection points with the actuation arms 4*b* whereby the elastic sealing collar 5*a* is dispensed with.

Figure 2:
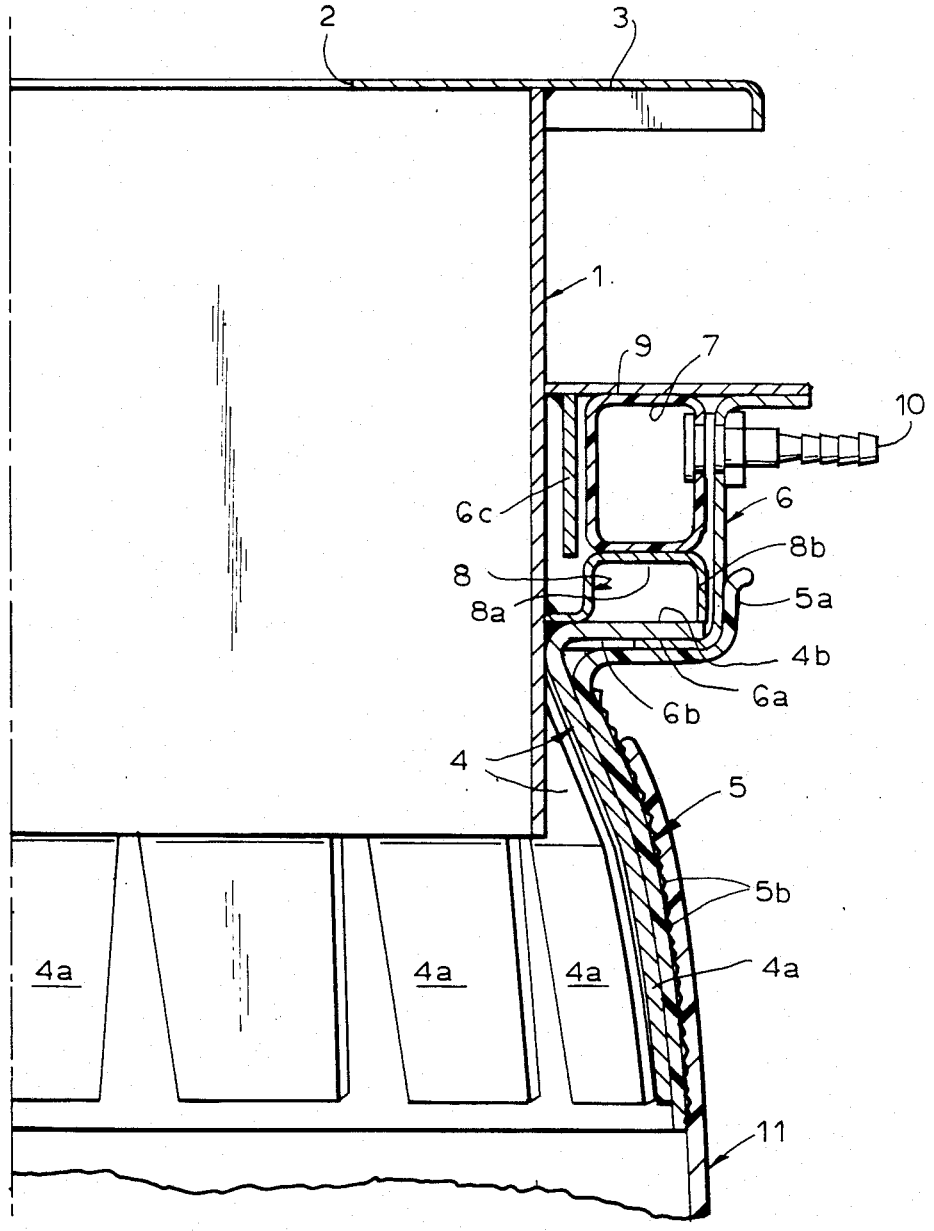
FIG. 2 shows the device of FIG. 1 in its expanded condition.

The operation of the releasable holding device of this invention is as follows:

Referring firstly to FIG. 1 showing the device in its rest position, as soon as a container to be charged is prepared by an automatic device into a ready position in which the lower segments 4*a* together with the corresponding portion of the surrounding sleeve 5 are immersed into the opening of the container, the pressure hose 7 is inflated by pressure air fed through a connection piece 10 whereupon in minute time interval the holding device of this invention is brought into its activated condition illustrated in FIG. 2. In the activated condition, the lifting ring 6 is moved by the inflated pressure hose 7 upwards away from the stop collar 8, thus pivotable via the actuation arms 4*b* the segments 4 about their contact point with the lower surface of the stop collar 8. The pivoting movement lasts so long until the tips of actuation arms 4*b* abut against the stop edge 8*b* of the stop collar. At this instant, the expanding segments 4 expand the lower part of the sleeve 5 into its working position in which it engages the entire periphery of an inner wall portion of the container and firmly holds it in open position on the feed piece. As an additional safety measure against disengaging of the container from the expanded sleeve, the latter is provided on its outer surface with serrations or with a fractional coating enhancing the engagement with the container. When the filling process is completed, pressure air is discharged from the hose 7 and due to the tensioning force of elastic sleeve 5 the holding device is returned into its rest position (FIG. 1) and after the removal and conveying of the filled-up container the device is ready for reactivation in the before described manner.

While the invention has been illustrated and described as embodied in a specific example of the holding device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for releasably holding a container on a feed connection piece, comprising a plurality of expansion segments arranged side by side and surrounding a rim of said connection piece; a resilient sleeve surrounding said segments and pressing a top edge of respective segments against an outer surface of said connection piece, actuation arms integrally connected to said top edges and including an acute angle with the segments; a circumferential stop collar secured to said outer surface of the connection piece above said actuation arms; levering means including a hollow lifting ring slidably engaging another section of the outer surface of the connection piece, said lifting ring enclosing said stop collar and said actuation arms, a bottom side of said lifting ring engaging said actuation arms; and means for moving said lifting ring in axial direction between an inactive position in which the ring rests on said stop collar and said top edge of the segments is in contact with said outer surface of the connection piece while a lower part of the segments extends over said rim, and an actuated position in which the ring is axially moved away from said stop collar and said bottom side of the ring tilts said actuation arms and said segments about said top edge against the constricting force of said resilient sleeve, thus expanding said sleeve against an inner wall of said container.

2. A device for releasably holding a container on a feed connection piece, comprising a plurality of expansion segments arranged side by side and surrounding a rim of said connection piece; a resilient sleeve surrounding said segments and pressing a top edge of respective segments against an outer surface of said connection piece actuation arms integrally connected to said top edges and including an acute angle with the segments; a circumferential stop collar secured to said outer surface of the connection piece above said actuation arms; levering means including a hollow lifting ring slidably engaging another section of the outer surface of the connection piece, said lifting ring enclosing said stop collar and said actuation arms, a bottom side of said lifting ring engaging said actuation arms; means for moving said lifting ring in axial direction between an inactive position in which the ring rests on said stop collar and said top edge of the segments is in contact with said outer surface of the connection piece while a lower part of the segments extends over said rim, and an actuation position in which the ring is axially moved away from said stop collar and said bottom side of the ring tilts said actuation arms and said segments about said top edge against the constricting force of said resilient sleeve, thus expanding said sleeve against an inner wall of said container; and a top part of said resilient sleeve forming a sealing collar enclosing an annular opening between said bottom side of said lifting ring and said outer surface of the connection piece.

3. A device as defined in claim 1, wherein said feed connection piece has a cylindrical jacket, said expanding segments having a flat configuration tangentially contacting said jacket, and said segments enclosing a polygonal area which approximates the circular cross sectional area of said jacket.

4. A device as defined in claim 3, wherein said lower parts of said segments are bent inwardly to converge in the inactive position of said lift ring toward a point on a center axis of said feed connection piece.

5. A device as defined in claim 2, wherein the top edge of each segment pivotably engages a lower side of said stop collar and a free end of each actuation arm pivotably engaging an inner surface of said bottom side of the lifting ring.

6. A device as defined in claim 5, wherein said moving means includes an inflatable pressure hose arranged in said hollow lifting ring between the top side thereof and a top surface of said stop collar, so as to axially move said lift ring away from said stop collar when inflated, thus pivoting said expanding segments about said top edges and expanding said resilient sleeve.

7. A device as defined in claim 1, wherein said resilient sleeve is provided with a friction enhancing upper surface.

* * * * *